US005850942A

United States Patent [19]

DeSimone et al.

[11] Patent Number: 5,850,942

[45] Date of Patent: Dec. 22, 1998

[54] PASTE DEPOSITOR FOR DISPENSING EXACT AMOUNTS OF A SMOOTH FOOD PRODUCT

[76] Inventors: Maurice R. DeSimone, 4941 Bulltown Rd., Murrysville, Westmoreland County, Pa. 15668; David C. Golembeski, 509 Cavitt Ave., Trafford, Westmoreland County, Pa. 15085

[21] Appl. No.: 550,012

[22] Filed: Oct. 30, 1995

[51] Int. Cl.[6] ..... B67D 5/62

[52] U.S. Cl. ..... 222/146.5; 222/183; 222/485; 222/561

[58] Field of Search ..... 222/131, 183, 222/330, 287, 146.5, 561, 565, 485; 165/169

[56] References Cited

U.S. PATENT DOCUMENTS

| | | | |
|---|---|---|---|
| 13,893 | 12/1855 | Wells | 222/287 |
| 2,391,876 | 1/1946 | Brown | 165/169 |
| 2,557,704 | 6/1951 | Stevens | 222/485 |
| 3,301,441 | 1/1967 | Werner et al. | 222/131 |
| 3,566,805 | 3/1971 | Meyer | 107/1 |
| 3,623,639 | 11/1971 | McShirley | 222/361 |
| 3,629,552 | 12/1971 | Edging | 222/146.5 |
| 4,537,211 | 8/1985 | Almedia | 137/1 |
| 4,767,030 | 8/1988 | Larson | 222/238 |
| 4,941,597 | 7/1990 | Lopez et al. | 222/146.5 |
| 5,218,898 | 6/1993 | Norris | 99/334 |

FOREIGN PATENT DOCUMENTS

| | | | |
|---|---|---|---|
| 2146309 | 4/1985 | United Kingdom | 222/361 |
| 2154205 | 9/1985 | United Kingdom . | |

*Primary Examiner*—Philippe Derakshani

[57] ABSTRACT

A paste-depositing apparatus comprising, a temperature-controlled hopper having an open upper end for receiving a batch of paste material and having a lower perforated end for dispensing the paste material, the lower perforated end including a lever-operated slide valve for opening and closing a plurality of inlet and outlet ports for discharging a row of paste material each time the lever is moved between a first and a second position.

15 Claims, 3 Drawing Sheets

PASTE DEPOSITOR FOR DISPENSING EXACT AMOUNTS OF A SMOOTH FOOD PRODUCT

FIELD OF THE INVENTION

This invention pertains to a food-depositing apparatus for dispensing equal amounts of a paste material into a carry member, and more particularly to a confectionery depositor including a temperature-controlled hopper having an upper loading inlet and having a lower dispensing outlet which includes a lever-operated slide valve for opening and closing a plurality of input and output ports each time the lever is moved between a first and a second position.

BACKGROUND OF THE INVENTION

It will be appreciated that there are various types of food-dispensing apparatuses, such as, paste depositors, which include one or more extruding screws or augers and rotating rollers which feed the paste material into a dispensing chamber which contain the rotating screws or augers. The rotating screws or augers then extrude the paste material through nozzles and deposit it onto a conveyor belt in one or a number of rows or lines. In such an arrangement, the rollers and screws or augers are located in a single housing in which the axles of the feed roller are in alignment with the axles of the extruding screws or augers. Usually, a drive transmission rotates the feed rollers in the opposite direction to the extruding screws or augers. If it is necessary to change the number of rows or lines which requires a change in the number of extruding screws or augers, it is necessary to redesign the entire depositor to conform the desired number of rows or lines. Such a redesign is not only expensive, but also time consuming which results in production delays and loss of revenue and earnings during the reconstruction. Another shortcoming of such previous food depositors is that, if more than one rotating screw or auger is situated in the same dispensing chamber, the distribution of the paste material throughout the dispensing chamber may not always be even so that the amount of extruded paste may not be the same amount. In confectionery and food manufacture, it is very important and essential to control the exact amount of paste material that is deposited.

OBJECTS AND SUMMARY OF THE INVENTION

Accordingly, it is an object of this invention to provide a new and improved paste depositor.

A further object of this invention is a novel food depositing apparatus including a temperature-control hopper having an upper loading end and a lower dispensing end.

Another object of this invention is to provide a unique paste-dispensing mechanism having a hopper including a top open end for receiving paste material and including a bottom perforated end for dispensing the paste material onto a receiving member.

Yet a further object of this invention is to provide an innovating confectionery depositor including a heated hopper for maintaining a uniform temperature and having a slide valve for dispensing the confectionery.

Yet another object of the invention is to provide an improved candy dispensing apparatus which includes a temperature-controlled hopper having an upper open end for receiving the candy and having a lower slide valve assembly having a plurality of openings for dispensing equal amounts of candy.

Still a further object of this invention is to provide an improved paste-depositing mechanism which is economical in cost, simple in construction, dependable in service, durable in service, and efficient in operation.

In the attainment of the foregoing objects, there is provided a paste-depositing apparatus comprising, a temperature-controlled hopper having an upper open end for receiving a batch of paste material and having a lower dispensing end for depositing the paste material, the lower dispensing end having at least one inlet opening for receiving the paste material from the hopper, a slidable member having at least one through hole for allowing the passage of a predetermined amount of paste material, and at least one outlet opening for releasing the predetermined amount of paste material.

DESCRIPTION OF THE DRAWINGS

The above objects and other attendant features and advantages will be more readily appreciated as the present invention becomes better understood by reference to the following detailed description when considered in conjunction with the accompanying drawings, wherein.

DETAILED DESCRIPTION OF THE INVENTION

Figure 1:
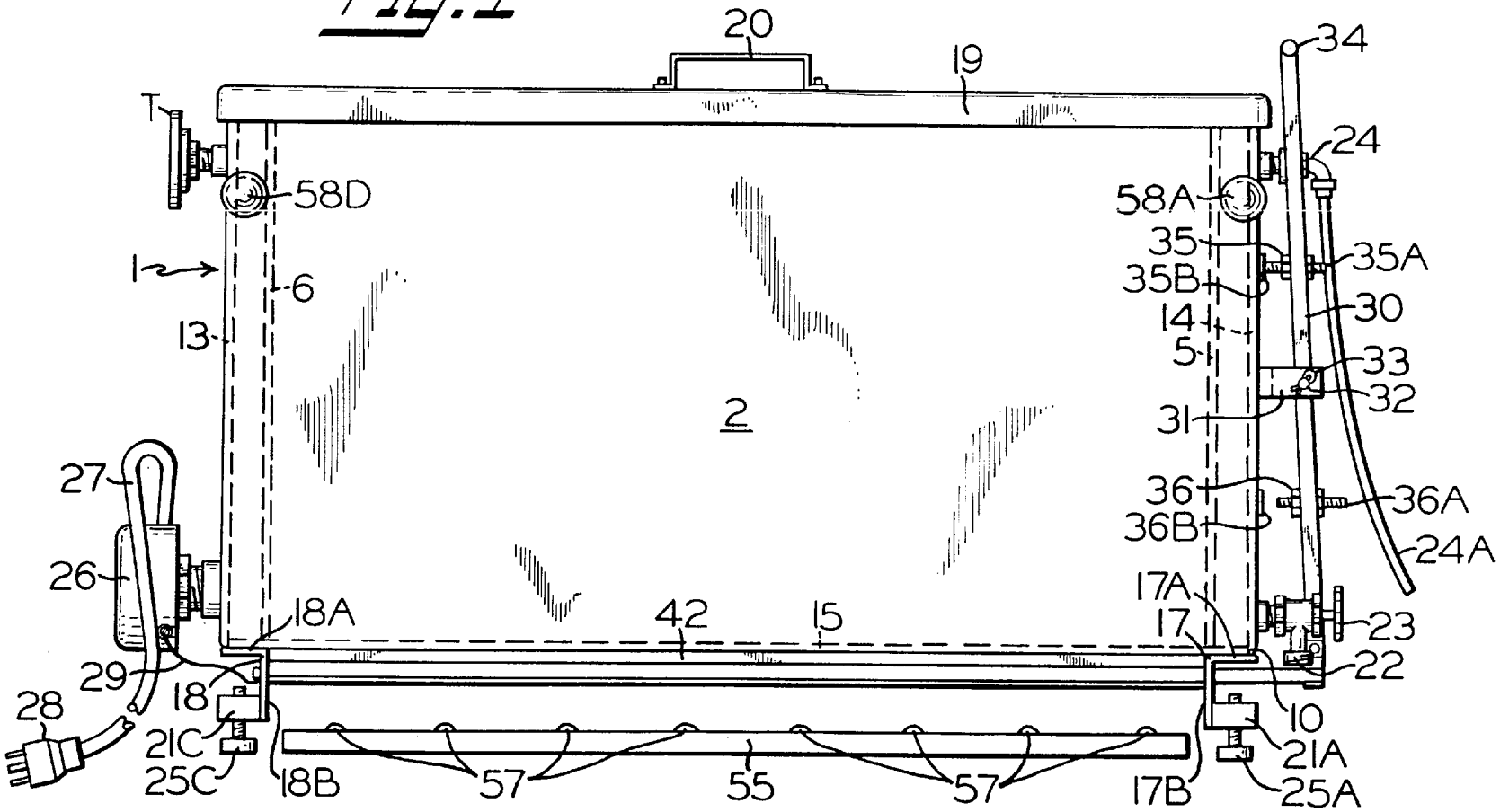
FIG. 1 is a side elevational view of the paste depositing apparatus in an open dispensing position in accordance with the present invention.
Figure 2:
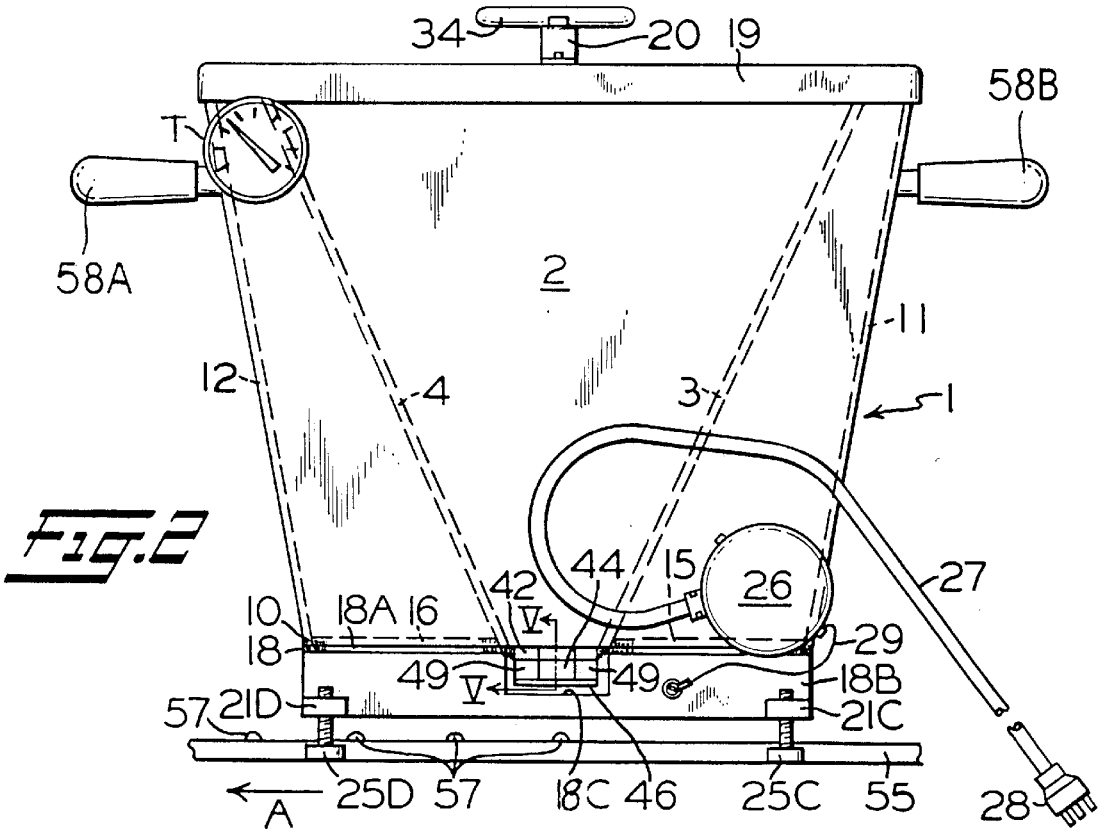
FIG. 2 is a rear elevational view of the paste-depositing apparatus of FIG. 1.
Figure 3:
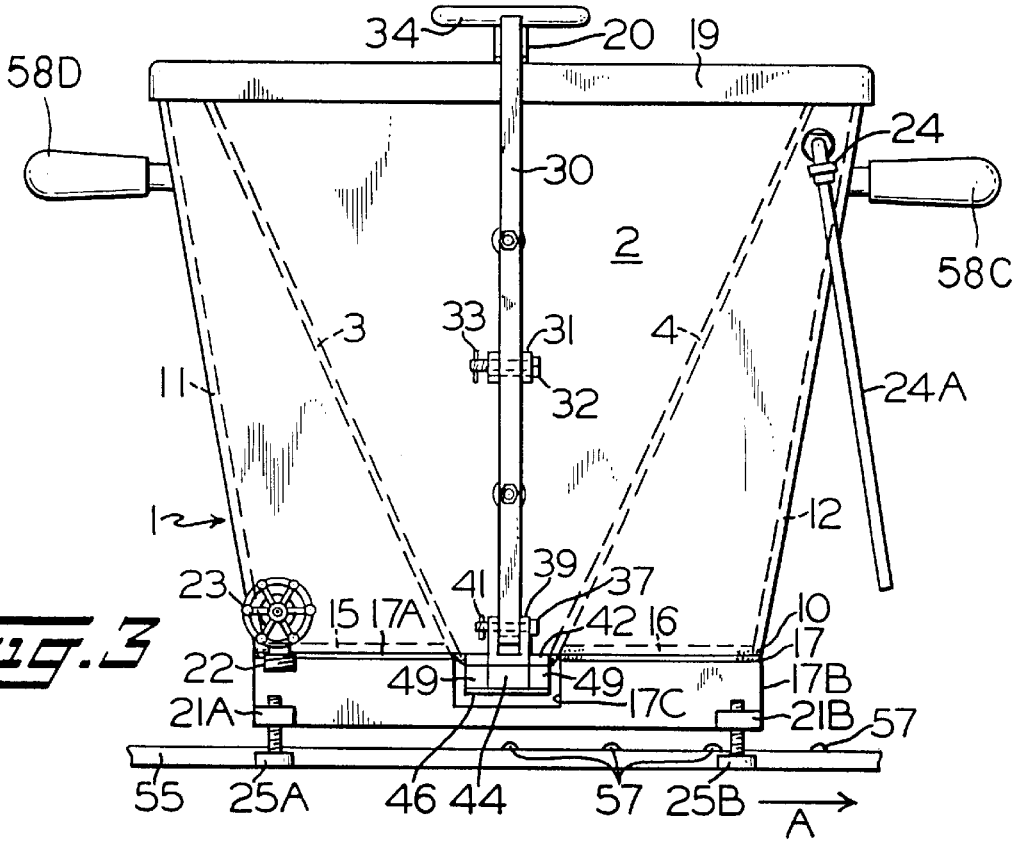
FIG. 3 is a front elevational view of the paste-depositing apparatus by FIG. 1.

Referring now to the drawings, and in particular to FIGS. 1, 2, and 3, there is shown a paste-depositing apparatus in accordance with the present invention. As shown, the paste-depositing apparatus or dispensing mechanism which is generally characterized by numeral 1 is mainly constructed of stainless steel and other noncorrosive materials which will be described hereinafter. In viewing FIGS. 2 and 3, it will be seen that the paste-depositing mechanism 1 includes a V-shaped receiving hopper 2 having a pair of inclined stainless steel side walls 3 and 4. The receiving hopper 2 also includes a vertical stainless steel front wall 5 and a vertical stainless steel back wall 6. The contiguous edges of the side walls 3 and 4 and the front and back walls 5 and 6 may be securely attached to each other in any suitable manner, such as, for example, by welding. It will be noted that the exterior of the paste-receiving hopper 2 is encased by a stainless steel water jacket 10 which is a weldment, or welded assembly made up of side members 11 and 12, front and rear end members 13 and 14, bottom members 15 and 16, and top members (not illustrated). The top of the hopper 2 is covered by a lid 19 having a handle 20.

Figure 4:
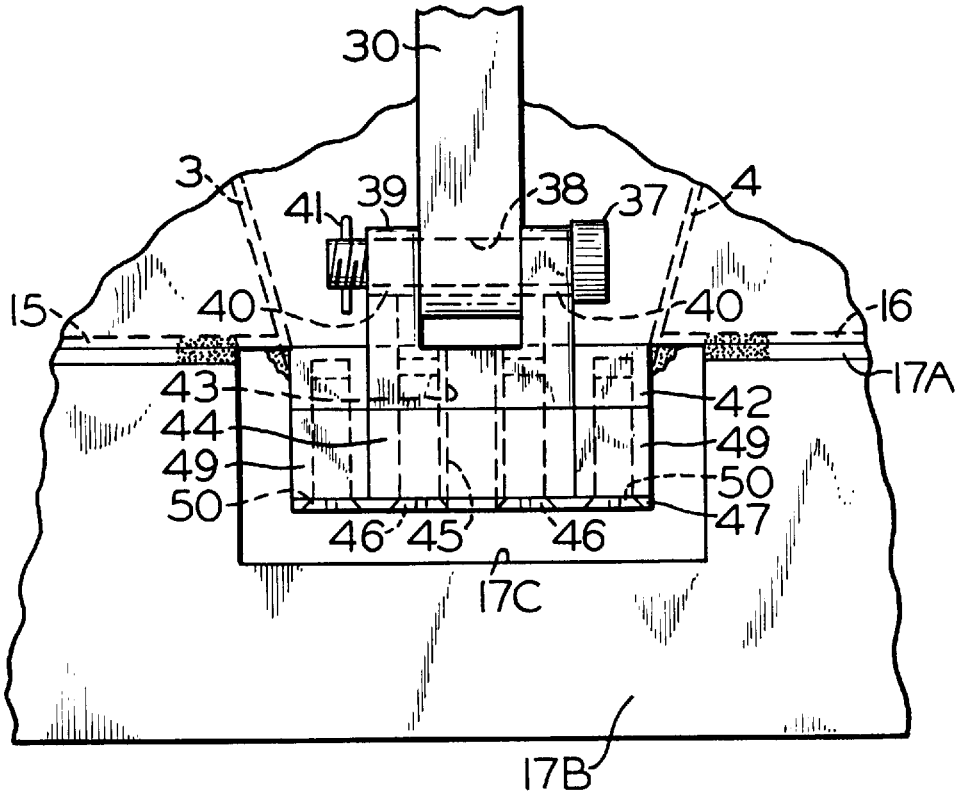
FIG. 4 is an enlarged broken-away frontal view of the operating lever and the slide valve assembly as shown in FIG. 3.
Figure 5:
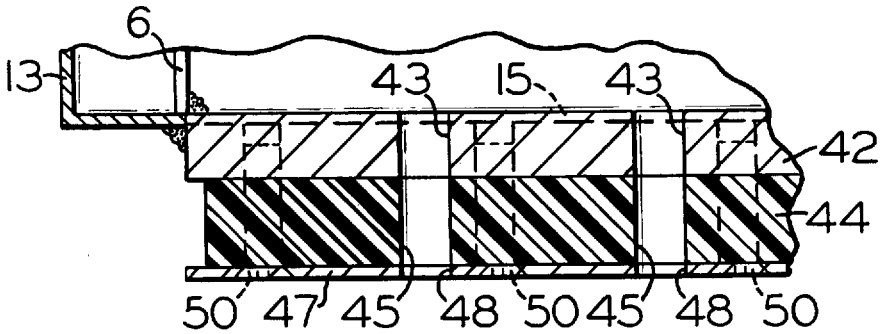
FIG. 5 is an enlarged broken-away cross-sectional view of the rear portion of the slide valve assembly taken along line V—V of FIG. 2.

It will be noted in FIGS. 1, 3, and 4 that the horizontal leg 17A of a front angle iron 17 is connected, such as, being welded to the bottom members 15 and 16. A rectangular cut-out section 17C is removed from the center of the vertical leg 17B of the front angle iron 17 to accommodate a slide valve, as will be described hereinafter.

In viewing FIG. 1, it will be seen that the horizontal leg 18A of a rear angle iron 18 is connected, such as, being welded, to the bottom numbers 15 and 16. A rectangular cutout section 18C is also removed from the center of the vertical leg 18B of the rear angle iron 18 to accommodate the slide valve. As shown in FIGS. 1 and 3, threaded blocks 21A and 21B are welded to the outer lower ends of the vertical leg 17B while as shown in FIGS. 1 and 2, threaded blocks 21C and 21D are welded to the outer lower ends of the vertical leg 18B.

In viewing FIGS. 1, 2, and 3, it will be seen that the threaded stems of leveler guides 25A and 25B are screwed into the taped holes of the blocks 21A and 21B while the threaded stems of leveler glides 25C and 25D are screwed into the taped holes of the blocks 21C and 21D.

In viewing FIGS. 1 and 3, it will be noted that a filler-drain valve or cock 22 is located at the lower extremity of the front end member or wall 14 of the water jacket 10. A hand-wheel 23 opens the valve 22 for filling up or draining the water jacket 10 and closes the valve 22 for retaining the water in the water jacket 10. It will be seen that an overflow fitting 24 and tube 24A are located at the upper extremity of the front end member 14 of the water jacket 10. The overflow 24, 24A prevents the pressure from building up in the water jacket 10 by purging excess water from the water jacket 10 during fill-up.

As shown in FIGS. 1 and 2, a pipe-threaded immersion heater 26 is located at the lower extremity of the rear end member or wall 13 of the water jacket 10. The electric immersion heater 23 is provided with a cord 27 and plug 28 for 120-volt AC service. Thus, when the water tank 10 is full, the heating elements are fully immersed in the water to provide uniform heating of the hopper 2 without any hot or cold spots. A bi-metal thermometer T is located at the upper extremity of the rear end wall 13 of the water jacket 10 and is provided with a ½' NPT threaded connection. the letters NPT stand for National Pipe Thread.

It will be noted that a ground wire 29 is connected from the metal casing of the heater 26 to the vertical leg 18B of the angle iron 18 to prevent electrical shock to an operator.

As shown in FIGS. 1, 3, and 4, a pivotal lever 30 is connected to the front end wall 14. A U-shaped bracket or fulcrum member 31 is welded to the outer central portion of the front wall 14. A pivot pin 32 is inserted through the aligned holes formed in the U-shaped fulcrum member 31 and a hole form in the intermediate portion of the operating lever 30. A cotter pin 33 is inserted in a hole formed in the remote end of pivotal pin 32 to prevent it from falling out during operation. It will be noted that the upper end of the pivotal lever 30 is provided with a manual operating handle 34 which is movable between two extreme positions by a confectioner. In viewing FIG. 1, it will be observed that an upper stop member 35 is located between the fulcrum point 31 and the operating handle 34. The stop member 35 includes an adjustable threaded stud member 35A and a stop or striker plate 35B which is welded to the exterior of the front end wall 14 to limit the counterclockwise movement or rotation of the pivotal lever 30. Similarly, a lower stop member 36 is located between the fulcrum point 31 and the lower end of the operating lever 30. The stop member includes an adjustable threaded stud member 36A and a stop or striker plate 36B which is welded to the exterior of the front end wall 14 to limit the clockwise movement or rotation of the pivotal lever 30.

As previously noted, a slide valve assembly is pivotally connected to the lower end of the operating lever 30. A pivot pin 37 is connected to a clevis U-shaped shackle member 39 which includes an enlarged opening 40 that is in alignment with the enlarged through hole 38 formed in the lower end of the pivotal lever 30. A cotter pin 41 prevents the pivot pin 37 from allowing the disengagement of the lever 30 and the clevis member 39. The slide valve assembly includes an upper apertured plate member 42 having a plurality of inlet openings 43 which is welded to the bottom wall members 15 and 16. The slide valve assembly also includes a plastic slide valve member which may be constructed of teflon or the like. The teflon slide valve member 44 includes plurality of through openings 45. The plastic slide valve 44 is attached to the clevis member 39 by a pair of flat head machine screws 46. The slide valve assembly includes a lower apertured plate member 47 which includes a plurality of outlet openings 48. A pair of side guide rails 49 are located between members 42 and 48. A plurality of flat head machine screws 50 secure the lower dispensing plate 47 and the two side guide rails 49 to the upper inlet aperture plate 42. In the present embodiment, the paste depositor 1 makes eight (8) deposits of paste material 57 per stroke of the operating lever 30. The deposits 57 of paste material are dropped onto a movable bakers tray or conveyor 55. In operation, the depositor 1 is designed to hold approximately fifty pounds (50 lbs.) of paste material, such as, caramel, licorice, or other candy or pastry material. The depositor 1 is designed for table-top operation and may be physically picked up by handles 58A–58D. Thus, the depositor 1 is relatively small and portable and may be easily stored out of the way when not in use.

Thus, the present invention has been described in such full, clear, concise and exact terms as to enable any person skilled in the art to which it pertains to make and use the same, and having set forth the best mode contemplated of carrying out this invention. We state that the subject matter, which we regard as being our invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims.

Having thus described the present invention, what we claim as new and desire to secure by Letters Patent is:

1. A paste-depositing apparatus comprising, a temperature-controlled hopper having an upper open end for receiving a batch of paste material and having a lower dispensing end for depositing said paste material, said lower dispensing end having at least one inlet opening for receiving the paste material from said hopper, a slidable valve member having at least one through hole for allowing the passage of (a predetermined amount of) paste material, (and) at least one outlet opening for releasing said (predetermined amount of) paste material, said slidable valve member is movable between two extreme positions by an operating mechanism, said operating mechanism includes a pivotal lever for moving said slidable valve member between said two extreme positions, said pivotal lever is operated to move said slidable valve member between a paste receiving position and a paste dispensing position, and said pivotal lever is limited to said two extreme positions by a pair of stop members.

2. The paste-depositing apparatus as defined in claim 1, wherein said temperature-controlled hopper includes an outer casing for holding water.

3. The paste-depositing apparatus as defined in claim 1, wherein said temperature-controlled hopper includes a water jacket.

4. The paste-depositing apparatus as defined in claim 2, wherein an electric heater maintains the temperature of the water at a proper level.

5. The paste-depositing apparatus as defined in claim 3, wherein said water jacket includes a valve for filling and draining the water.

6. The paste-depositing apparatus as defined in claim 2, wherein said outer casing includes an overflow for allowing the escape of excess water.

7. The paste-depositing apparatus as defined in claim 2, wherein a temperature gage monitors the temperature of said water.

8. The paste-depositing apparatus as defined in claim 1, wherein said slidable valve member is movable to a first position in which said at least one inlet opening is aligned with said at least one through hole for receiving said paste material.

9. The paste-depositing apparatus as defined in claim 1, wherein said slidable valve member is movable to a second position in which said at least one through hole is aligned with said at least one outlet opening for releasing said paste material.

10. The paste-depositing apparatus as defined in claim 1, wherein said pivotal lever is connected to said slidable valve member for allowing free movement between said two extreme positions.

11. The paste-depositing apparatus as defined in claim 1, wherein said lower dispensing end includes a plurality of inline inlet openings.

12. The paste-depositing apparatus as defined in claim 10, wherein said slidable valve member includes a plurality of inline through holes which may be aligned with said plurality of inline openings of said lower dispensing end.

13. The paste-depositing apparatus as defined in claim 12, wherein said lower dispensing end includes a plurality of inline outlet openings which may be aligned with said plurality of inline through holes.

14. The paste-depositing apparatus as defined in claim 1, wherein said slidable valve member is a nonsticking plastic material.

15. The paste-depositing apparatus as defined in claim 1, wherein said hopper is constructed of stainless steel.

* * * * *